US008100397B2

(12) United States Patent
Sardella

(10) Patent No.: US 8,100,397 B2
(45) Date of Patent: Jan. 24, 2012

(54) FEEDER WITH ADJUSTABLE TIME CYCLE AND METHOD

(75) Inventor: Louis M. Sardella, Shrewsbury, PA (US)

(73) Assignee: Sun Automation, Inc., Sparks, MD (US)

( * ) Notice: Subject to any disclaimer, the term of this patent is extended or adjusted under 35 U.S.C. 154(b) by 0 days.

(21) Appl. No.: 12/583,200

(22) Filed: Aug. 17, 2009

(65) Prior Publication Data

US 2010/0044948 A1 Feb. 25, 2010

Related U.S. Application Data

(62) Division of application No. 11/319,096, filed on Dec. 28, 2005, now Pat. No. 7,635,124.

(51) Int. Cl.
*B65H 5/00* (2006.01)

(52) U.S. Cl. ..... 271/10.06; 271/11; 271/35

(58) Field of Classification Search ..... 271/11, 271/10.06, 94, 99, 34, 35
See application file for complete search history.

(56) References Cited

U.S. PATENT DOCUMENTS 4,045,015 A * 8/1977 Sardella ..... 271/112
6,829,969 B1 * 12/2004 Sullivan ..... 83/298
2002/0131802 A1 * 9/2002 Shimizu et al. ..... 399/405

* cited by examiner

*Primary Examiner* — Michael McCullough
(74) *Attorney, Agent, or Firm* — William E. Mouzavires

(57) ABSTRACT

A timed feeder for feeding corrugated boards to nip rolls of a box finishing machine. An indexing drive mechanism, driven by a computer-controlled servo motor, activates a feed member and has a feed phase when it drives the board to the nip rolls, and a dwell phase when the feed member is away from the feed path and the output shaft of the indexing mechanism is at zero velocity. During the feed phase, the output shaft of the indexing mechanism accelerates the feed member and the board beyond the nip roll velocity and then decelerates them to the nip roll velocity at the point where the board enters the nip rolls. During the dwell phase the input shaft is either accelerated or decelerated to change the duration of the cycle.

19 Claims, 10 Drawing Sheets

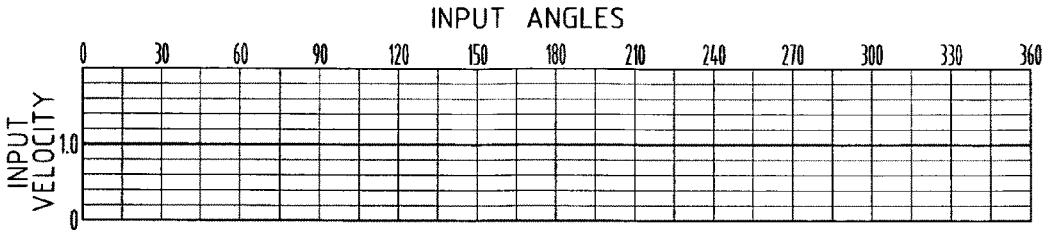
NEUTRAL SHEET LENGTH FIG. 8
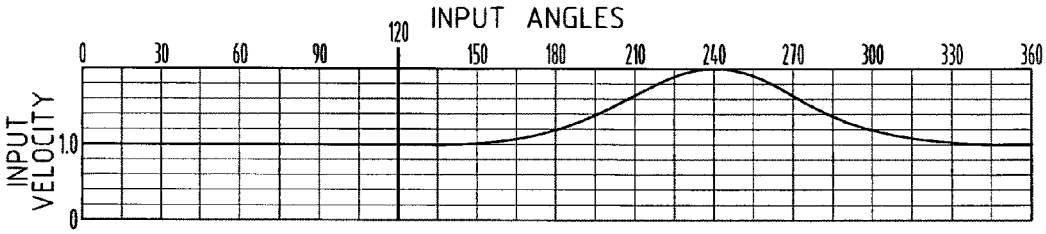
SHORT SHEET FIG. 8a
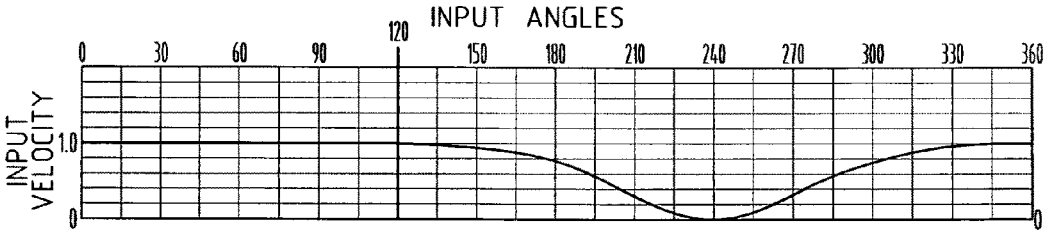
LONG SHEET FIG. 8b
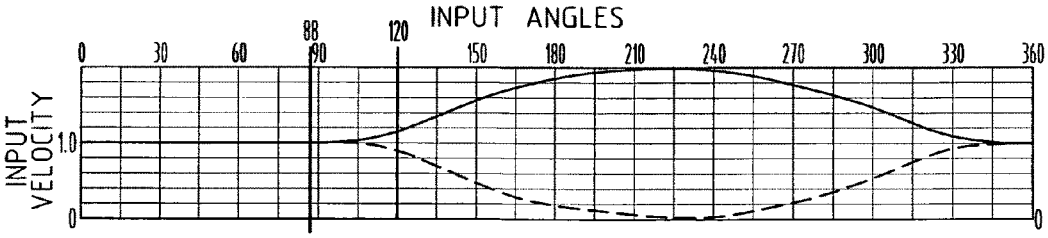
VARIATION ON START POINT FIG. 8c

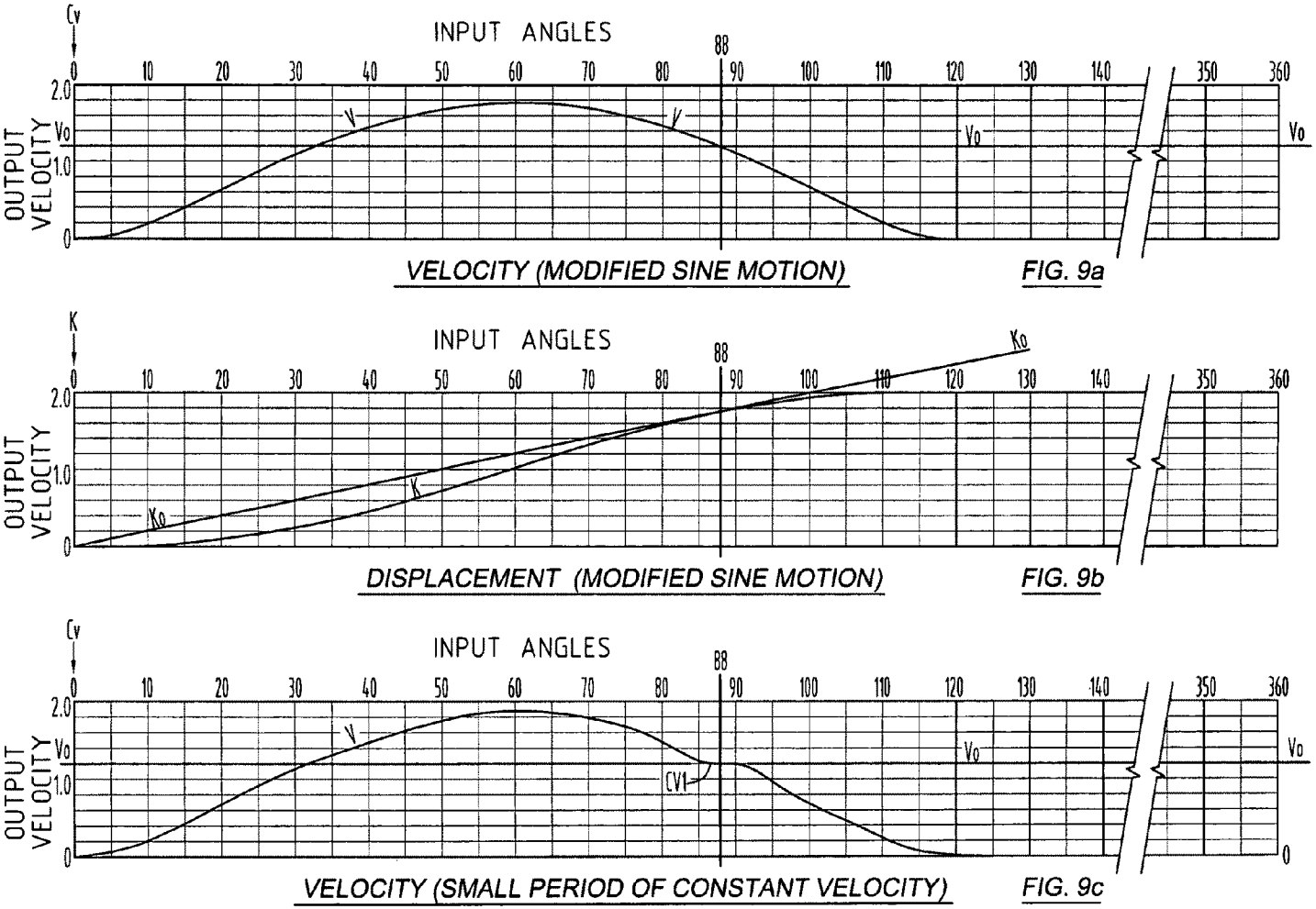
FIG. 9a VELOCITY (MODIFIED SINE MOTION)
FIG. 9b DISPLACEMENT (MODIFIED SINE MOTION)
FIG. 9c VELOCITY (SMALL PERIOD OF CONSTANT VELOCITY)

FEEDER WITH ADJUSTABLE TIME CYCLE AND METHOD

RELATED APPLICATION

This application is a division of U.S. patent application Ser. No. 11/319,096 filed Dec. 28, 2005 now U.S. Pat. No. 7,635,124 entitled: FEEDER WITH ADJUSTABLE TIME CYCLE AND METHOD.

BACKGROUND OF INVENTION

The present invention generally relates to feeders and in one preferred embodiment a timed feeder and method of feeding articles such as sheets towards one or more stations where an operation is performed on the article. For example, in the corrugated board art, a timed feeder is used to feed corrugated boards to a box finishing machine where the boards are slit, slotted and/or scored, and printed. It is essential that the boards be fed in synchronism or in "register" with operations performed on the board downstream. Therefore the time it takes for each fed board to reach the same location downstream is always the same. That is to say that for a given process each board is fed at the same time cycle or interval, and the distance between the leading ends of successive boards is always the same. Typically the boards are first fed to nip rolls which then feed the boards downstream to a printer after which the boards are conveyed to a slitting, slotting or scoring die. Various examples of timed corrugated board feeders may be found in U.S. Pat. Nos. 4,045,015; 4,494,745; 4,632,378; 4,681,311; 4,889,331 and 5,184,811.

With timed feeders such as those identified above, the distance between successive boards measured between their leading ends is constant, and this distance is called the "repeat length" in the art. Where the finishing machine includes a rotatable print cylinder, the circumferential length of the print cylinder is equal to the repeat length of the feeder. In the box finishing art, timed feeders are used to feed boards of different sizes, but with the same repeat length. This is inefficient because the space between the boards increases when different boards of shorter length are processed. This slows down production rate and also can cause loss of vacuum in machines which utilize vacuum in conveying the boards.

In the art of "one pass" digital printing where the printing is completed in one pass of the sheet being printed, the gap or space between the sheets being printed should be at a minimum if not nil to avoid air flow between the gap which can adversely affect the printing.

In industry there is a need for a timed feeder which is practical or feasible to use and at the same time allows the repeat length or time cycle of the feeder between successive sheets, to be easily adjusted to accommodate articles, such as sheets, of different lengths. In an attempt to provide such a feeder, one may envision the use of programmable servo motors to directly drive the feeding elements of a feeder. This would allow the speed of the feeding elements, and consequently the time cycle, to be changed as desired in order to arrive at a suitable time cycle or repeat length depending upon the length of an article being fed. However due to the relatively high loads from the inertia of the drive transmission system and the sheet being fed as well as from the vacuum forces imposed on the belts and sheets, this approach is not believed to be satisfactory because it would require very large and cumbersome servo motors and space to house them while also being difficult to design, all of which renders the proposition impractical or too expensive if not unfeasible.

In an attempt to reduce or close the gap between the fed articles, one might also envision driving downstream nip rolls with servo motors. However this would still be unsatisfactory because the drive of the nip rolls would conflict with the drive elements downstream of the nip rolls. In addition it would increase the expense and complicate the nip roll drive system.

Although rotating stream feeders are capable of feeding sheets with relatively high speed and small gaps between sheets, they are not suitable for timed feeding because the sheets are subject to slippages and the size of the gaps between the sheets are not consistent such that the sheets cannot be consistently fed with register or synchronism with downstream operations to be performed on the sheets.

OBJECTS OF THE PRESENT INVENTION

A primary object of the present invention is to provide a novel and improved feeder that can feed articles such as sheets with precise and predetermined spacing between the sheets and which also can be adjusted to change the spacing depending on the length of the sheets being fed. Included herein is such a feeder that can feed sheets with a consistent minimum spacing or no spacing between the sheets.

Another object of the present invention is to provide a timed feeder that will feed articles, such as sheets, with precise timing and arrangement and yet can be easily adjusted to feed articles of different lengths without slippage.

A further object of the present invention is to provide a novel timed feeder which can be adjusted to change the time cycle or distance between the leading ends of successive articles fed by the feeder. Included herein is such a feeder that may be adjusted to increase or reduce the time cycle between successive articles being fed in a given process depending on the size of the article or any other factor.

A further object of the present invention is to provide a novel and improved timed feeder for feeding corrugated boards without slippage to a box finishing machine in synchronism with downstream operations performed on the boards.

Another object of the present invention is to provide a novel timed feeder for feeding articles such as sheets to a one-pass digital printer. Included herein is the provision of such a feeder that will feed the articles with little or no space between the articles.

A further object of the present invention is to provide a novel timed feeder that is accurate and reliable in use while being capable of increasing production of articles being processed along a feed path.

A still further object of the present invention is to provide a novel timed feeder that will achieve the above objects and yet is feasible to manufacture and use in industry. Included herein is such a feeder that can incorporate an indexing cam or Geneva mechanism to drive the articles and yet can be easily adjusted to feed articles of different lengths with precise timing and arrangement.

SUMMARY OF PREFERRED EMBODIMENT OF THE PRESENT INVENTION

The preferred embodiment of the feeder of the present invention includes an indexing drive mechanism to drive a conveyor or feed member which engages and drives the sheet or board articles downstream of the feeder. During what will be termed herein as the "beta" or "feeding" phase of the indexing drive mechanism, the article is driven a predetermined distance during which the input shaft to the indexing mechanism rotates with constant velocity while the output shaft of the indexing mechanism first accelerates and then decelerates the article. In this phase, when the feeder is used to feed corrugated boards to nip rolls of a box finishing machine, the board is first accelerated to a speed greater than the nip roll speed and then decelerated to the nip roll speed as the board enters the nip rolls.

During the next phase of the indexing mechanism, which may be termed the "dwell" phase, the output shaft of the indexing mechanism is at zero velocity but the velocity of the input shaft may be varied to either increase or decrease the dwell period and thereby the time cycle and the repeat length between the leading ends of successive boards being fed. A servo motor is used to drive the input shaft of the indexing mechanism at constant speed during the feeding phase and at variable speed (acceleration or deceleration) during the dwell phase. If the input shaft is driven at a constant speed throughout both the feeding and dwell phases, the length of sheet which would be fed with zero gap between sheets will be referred to as the "neutral" length or neutral repeat length. In situations where the feeder is to process articles of shorter length than neutral length articles, the servo motor or its program is simply adjusted, preferably through a computer, to increase the speed of the input shaft of the indexing mechanism during the dwell period and then reduce the speed just prior to the start of the next feeding phase. This will shorten the dwell period and cause the feeding phase to occur sooner thereby reducing the space between the articles to increase the production rate.

In situations where the articles to be fed are longer in length than the neutral length, the time of the dwell phase must be increased and this is easily done by simply adjusting the program of the servo motor to decelerate the speed of the servo motor and consequently the speed of the input shaft and then increase the speed just prior to the start of the next feeding phase. This will increase the dwell time to the next feeding cycle so as to accommodate the increased length of the articles. Through the use of a computer the speed of the servo motor may be programmed to set and automatically control the speed of the input shaft during the feeding and dwell phases of the indexing drive mechanism for each feeding process depending on the length of the articles being fed in that process. Thus during each feeding process the speed of the input shaft will be predetermined and automatically changed from the feeding phase to the dwell phase. Moreover the input speeds may be easily changed to accommodate other articles of various sizes.

When the feeder is used to feed corrugated boards to a box finishing machine, the conveyor member is engaged with the board during the feeding or beta phase of the indexing mechanism and disengaged at the point where the board is decelerated to the nip roll velocity and enters the nip rolls. The conveyor member remains unengaged with respect to the board until the next feeding phase begins at which point the conveyor member engages the next preceding board to start the cycle again.

DRAWINGS

Other objects of the present invention will become more apparent from the following more detailed description taken in conjunction with the attached drawings in which:

FIG. 8 is a graph illustrating the neutral length of a sheet used to determine how much time cycle should be increased or decreased for sheet lengths less or greater than the neutral length;

FIGS. 8*a* through 8*c* are graphs illustrating the velocity of the input shaft of the indexing drive mechanism during a cycle of the latter for different settings of the machine of the present invention;

FIGS. 9*a* and *c* are graphs illustrating the velocity of the output shaft of the indexing drive mechanism during a cycle of the latter for different settings of the machine;

FIG. 9*b* is a graph illustrating the displacement of preceding and trailing boards as they are fed by the feeder and the gap between these boards; and FIGS. 10*a* through *e* are side, elevational views of the feeder illustrating sequential positions of the boards being fed during a feeding cycle.

DETAILED DESCRIPTION

Figure 1:
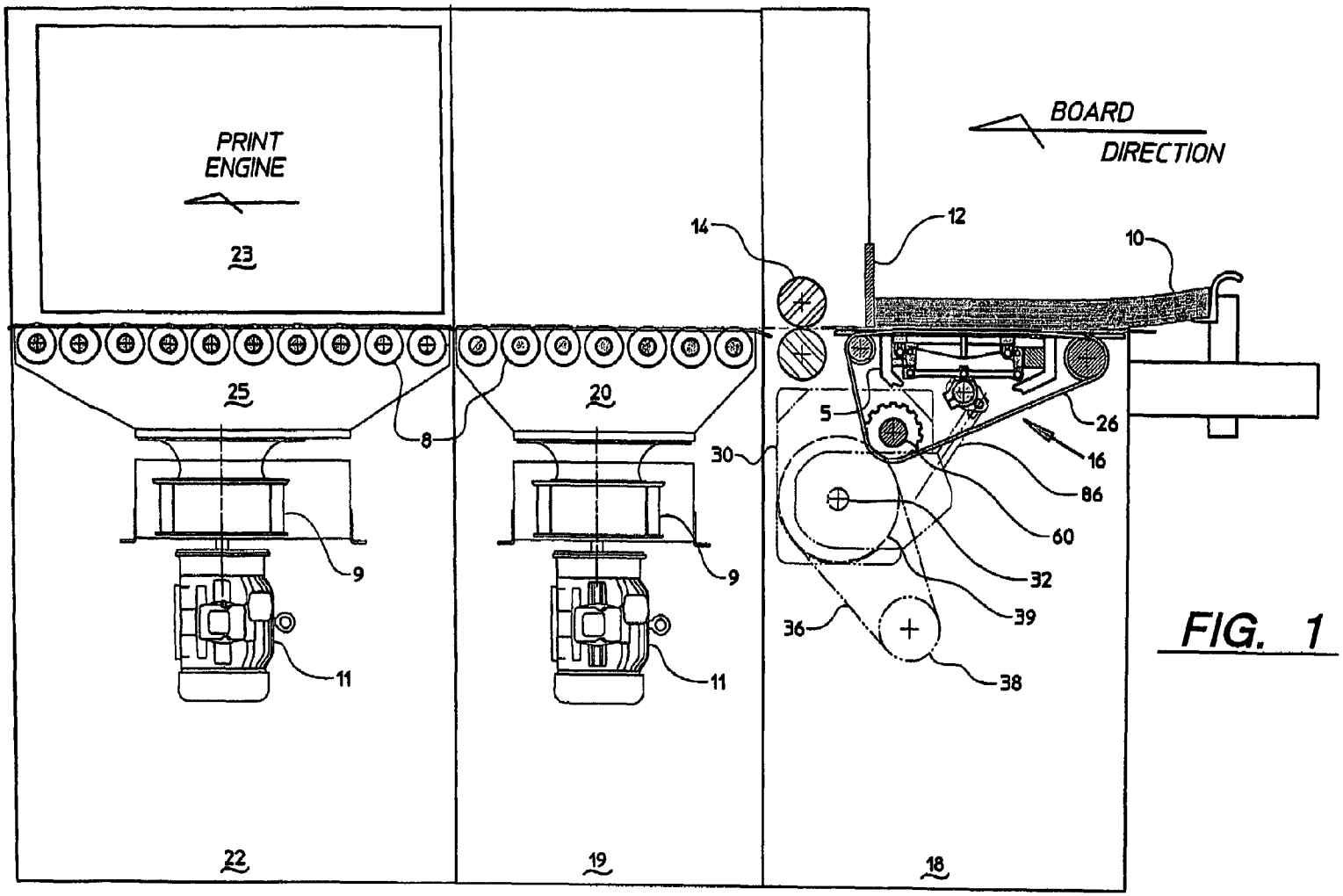
FIG. 1 is an elevational view in cross-section of a portion of a box finishing machine incorporating a timed feeder constituting a preferred embodiment of the present invention.
Figure 2:
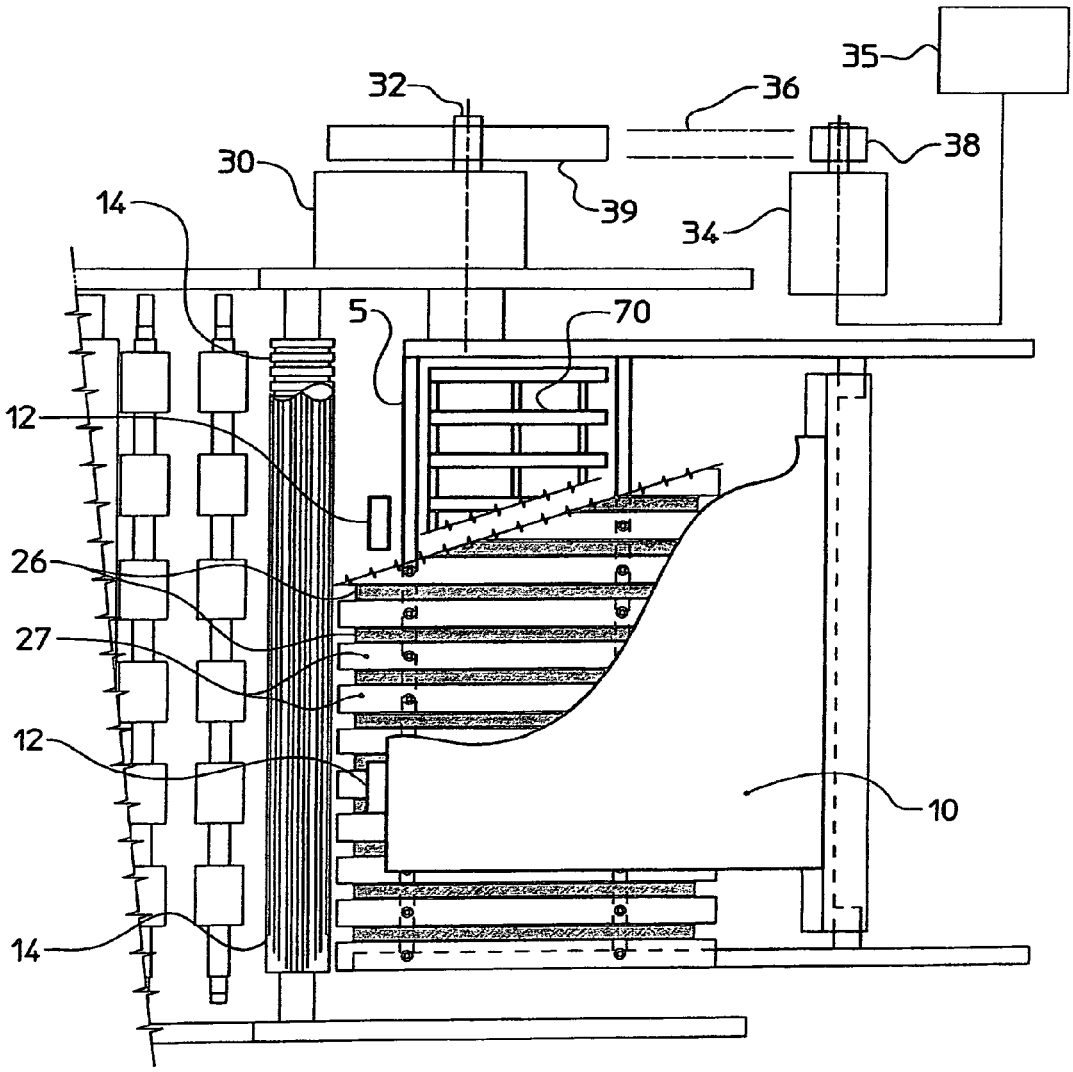
FIG. 2 is a plan view of the machine of FIG. 1 with portions broken away.

Referring to the drawings in detail, there is illustrated in FIGS. 1 and 2 for illustrative purposes only, a box finishing machine for transporting and digitally printing corrugated boards 10. The latter are fed in register from a stack under a gate 12 to a pair of nip rolls (also called "feed rolls") 14 by a timed feeder generally designated 16 embodying the present invention positioned at a feed station 18. Nip rolls 14 convey the boards 10 to a transport station 19 which may have equipment for cleaning and surface treatment (not shown). The boards 10 are then conveyed by a vacuum transfer unit 20 to a printing station 22 where indicia are printed on them preferably by a digital printer 23. Next the boards are conveyed through the printing station by a vacuum transfer unit 25 after which they are conveyed to a downstream station (not shown) for further processing such as drying, stacking or die cutting. Movement of the boards 10 to each of the stations is synchronized so that they can arrive at the station at the right time for each of the operations to be performed on them. To that end it is imperative that the feeder 16 feed the boards 10 in register with the nip rolls 14 and the mechanisms at the stations downstream. Boards 10 are conveyed to the stations by rolls 8 while the boards are held on rolls 8 by vacuum generated blowers 9 driven by motors 11 as shown in FIG. 1.

Figure 5:
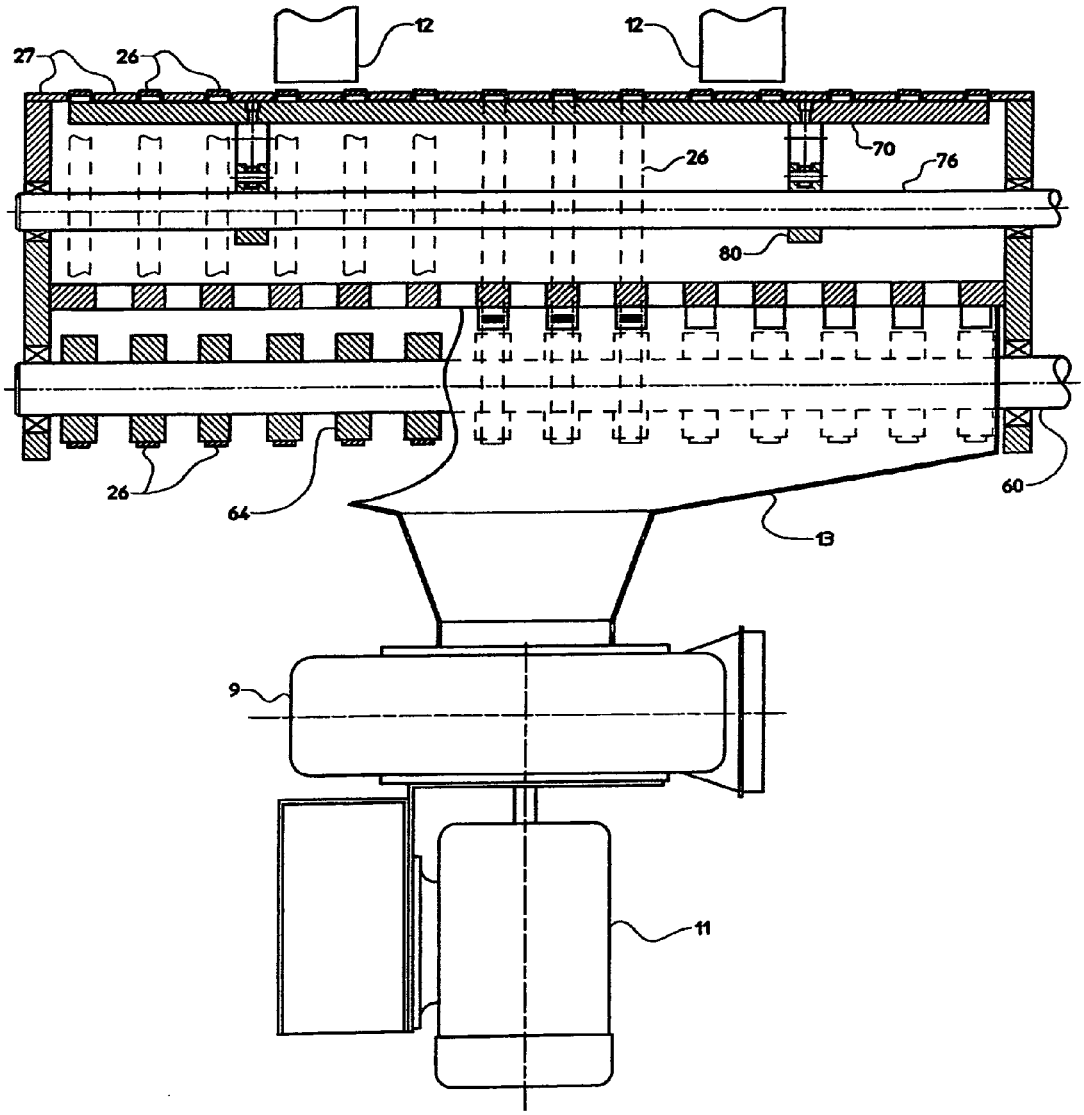
FIG. 5 is a cross-sectional view of the feeder taken transversely of the path of travel of the boards being fed and with portions broken away.

In the specific embodiment shown, feeder 16 includes a plurality of parallel endless belts 26 for driving the boards to nip rolls 14 when the belts are in an upper position engaging the lower most board 10 in the supply stack. In the specific embodiment shown, belts 26 pass over a grate 70 at the top of a vacuum box 5 in which a vacuum is produced to hold the boards 10 on belts 26 by means of a blower 9 driven by a motor 11 whose inlet is connected to manifold 13 as shown in FIG. 5. As will be described further below, grate 70 is movable upwardly to engage belts 26 with the board 10 to transport the same, and downwardly away from the belts to release the same when the board reaches nip rolls 14. When the grate 70 and belts 26 are in their lowermost position spaced from boards 10, the latter are supported on elongated strips 27 fixed to the top of vacuum box 5 and located between the belts 26 respectively as shown in FIGS. 1, 2, 3 and 5. The feeding of boards 10 by belts 26 is timed as will be described further below so that when the preceding board clears the gate 12 the next board begins to be fed by conveyor belts 26 (see FIGS. 10*c* and *d*) and catches up with the preceding board at the nip rolls 14 as the trailing end of the preceding board leaves the nip rolls 14 (see FIG. 10*e*). The cycle of movement and dwell of the conveyor belts 26 consists of a drive or beta phase during which the belts drive the board to the nip rolls 14 and a dwell phase during which the belts are at rest and out of engagement with the board which rests on support strips 27. The cycle is of course repeated throughout the process.

Endless belts 26 are driven by an indexing drive mechanism generally designated 30 of the general type shown in U.S. Pat. Nos. 4,494,745 (Ward et al.) and 4,681,311 (Sardella). However in accordance with the present invention, the present drive mechanism differs from the aforementioned mechanisms in that it is driven by a computer controlled servo motor and designed and/or programmed so that during the drive or "beta" phase of its cycle it drives the conveyor belts 26 with acceleration beyond the speed of the nip rolls 14 and then with deceleration until it reaches the speed of the nip rolls just when the board arrives at the nip rolls. In addition, and preferably through the use of the servo motor and its computer, the input of the present indexing drive can be adjusted and/or programmed to either accelerate then decelerate during the dwell phase of the cycle to decrease the time duration and repeat length of the cycle or decelerate then accelerate during the dwell phase to increase the time duration and repeat length of the cycle. In other words, the duration of the dwell phase is decreased for shorter sheets and increased for longer sheets. Thus to accommodate shorter length boards, the input shaft of the indexing mechanism can be adjusted to accelerate then decelerate the boards during the dwell phase to reduce the repeat length and the space between the boards; and to accommodate longer length boards it can be adjusted to decelerate then accelerate during the dwell phase to increase the repeat length to accommodate the longer length boards. The time duration of the dwell phase and in turn the cycle of the indexing mechanism and the repeat length can be increased or decreased to accommodate boards of different lengths while at the same time allowing the space between the boards to be a minimum if not zero to increase efficiency and production as well as to decrease if not prevent air flow between the boards that can adversely affect the printing of the boards. The present invention easily accomplishes the foregoing adjustment by programming the servo motor 34, preferably controlled by a computer 35, to accelerate and decelerate or decelerate and accelerate when the boards 10 are at rest and the output shaft is at zero velocity thereby significantly reducing the drag and inertial resistance loads on the servo motor during the dwell phase. This adjustment is a great advantage over the prior art of timed feeders where repeat length is typically constant regardless of the length of the boards. Moreover the fact that the inertia loads are reduced during the dwell period allows a servo motor of practical size or capacity to be utilized.

Figure 3:
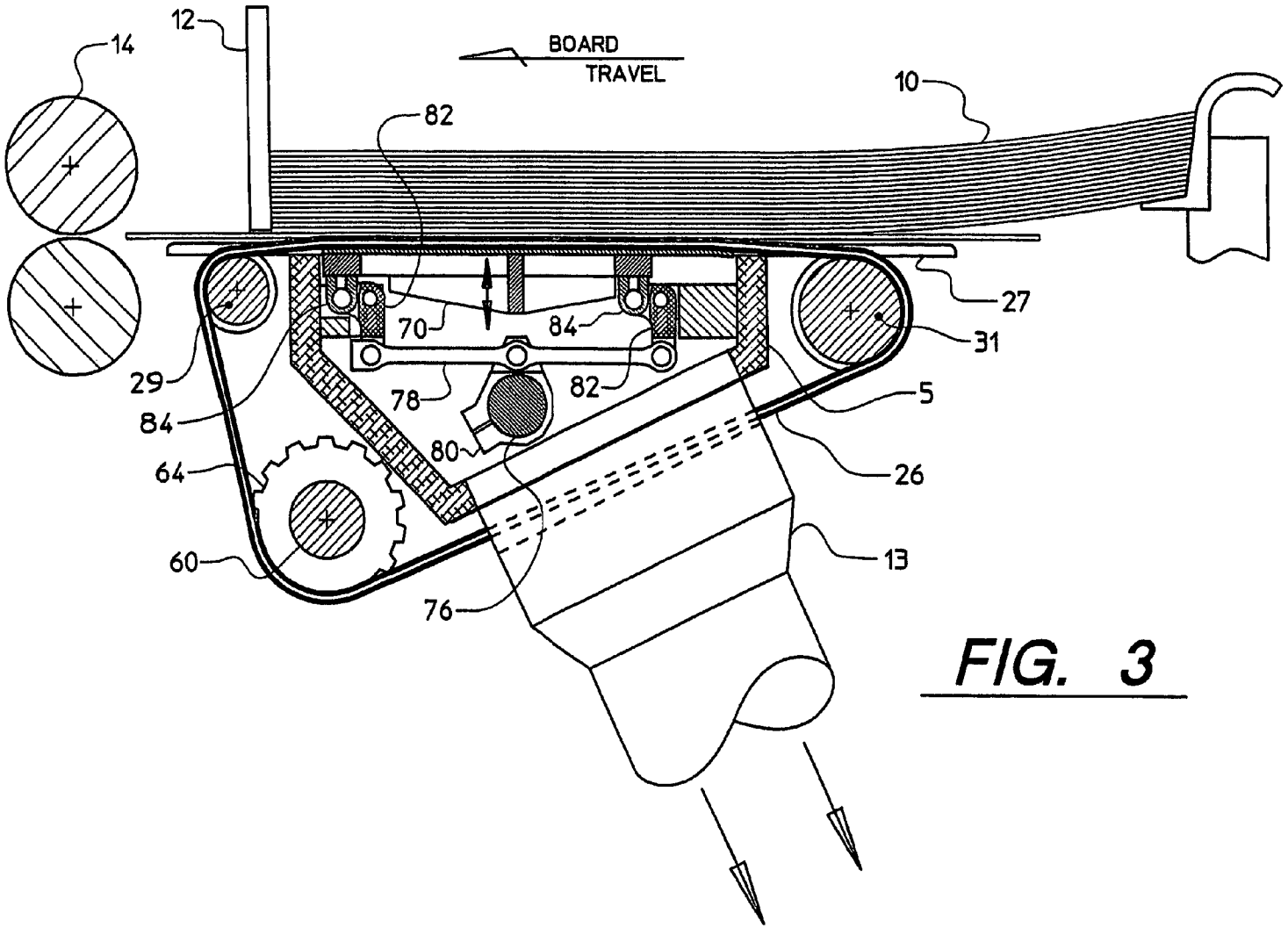
FIG. 3 is an enlarged view of the feeder and nip rolls as shown in FIG. 1.

Referring to FIGS. 1, 2, 4 and 7, the indexing drive 30 in the preferred embodiment shown includes an input shaft 32 driven by a servo motor 34 through a belt 36 and pulleys 38 and 39. Fixed to the input shaft 32 are conjugate cams 41 shown in FIGS. 4 and 7 as including side by side peripheral portions 42 and 44 engageable with cam followers 46 and 48 on a wheel 50, the latter being mounted on shaft 52. Cam followers 46 and 48 are rollers having shafts 49 held in flange plates 51 of wheel 50. An output gear 54 on shaft 52 and fixed to the follower wheel 50, is in mesh with a gear 56 fixed on an output shaft 60. Input and output shafts 32 and 60 are suitably journalled for rotation in the casing of frame 62 of the indexing drive mechanism. Fixed to and along the output shaft 60 are a plurality of pulley gears 64 engaged with the drive belts 26 respectively, see also FIGS. 2, 3 and 5. As shown in FIG. 3, belts 26 are trained about idler shafts 29 and 31 and drive gears 64 which drive belts 26 when output shaft 60 undergoes periodic indexing rotation produced by rotation of the follower wheel 50 by cams 42 and 44 which are driven by input shaft 32 under the control of servo motor 34. The cam surfaces 42 and 44 of cams 41 and gears 54 and 56 (FIG. 4) are shaped and designed to provide the desired acceleration, deceleration, and zero velocity of the output shaft 60. The servo motor 34 and its gearing 38, 39 to the input shaft 32 are designed to impart the desired velocity, acceleration and deceleration to the input shaft 32 as shown for example in FIGS. 8*a* and 8*b*. Moreover the velocity, acceleration, and deceleration of servo motor 34 is preset and controlled by computer 35 in accordance with the length of the boards 10 being processed in a particular operation as will be described further below.

Figure 4:
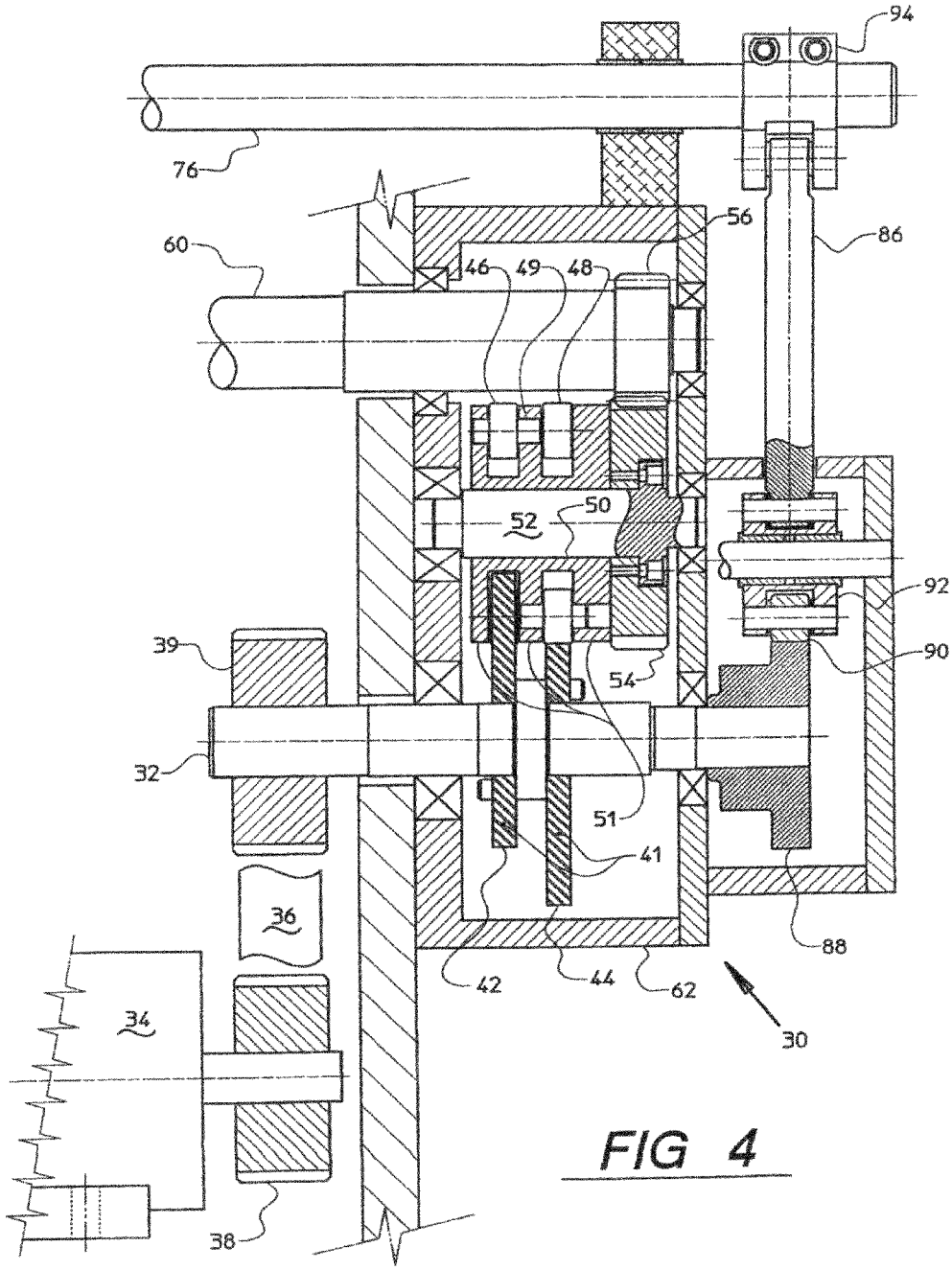
FIG. 4 is a cross-sectional view of an indexing drive mechanism for driving the feeder.
Figure 6:
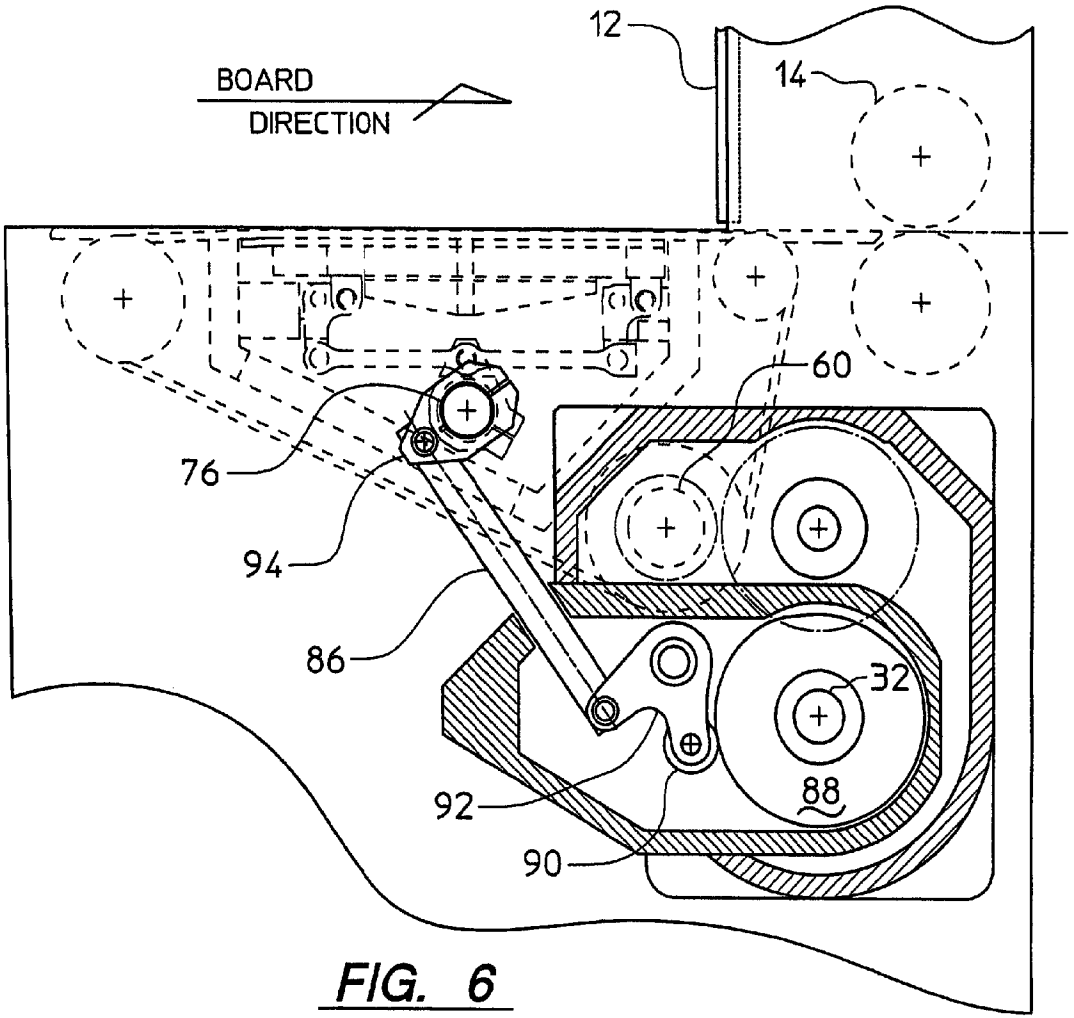
FIG. 6 is a cross-sectional view showing the drive for engaging and disengaging conveyor belts with the boards.
Figure 7:
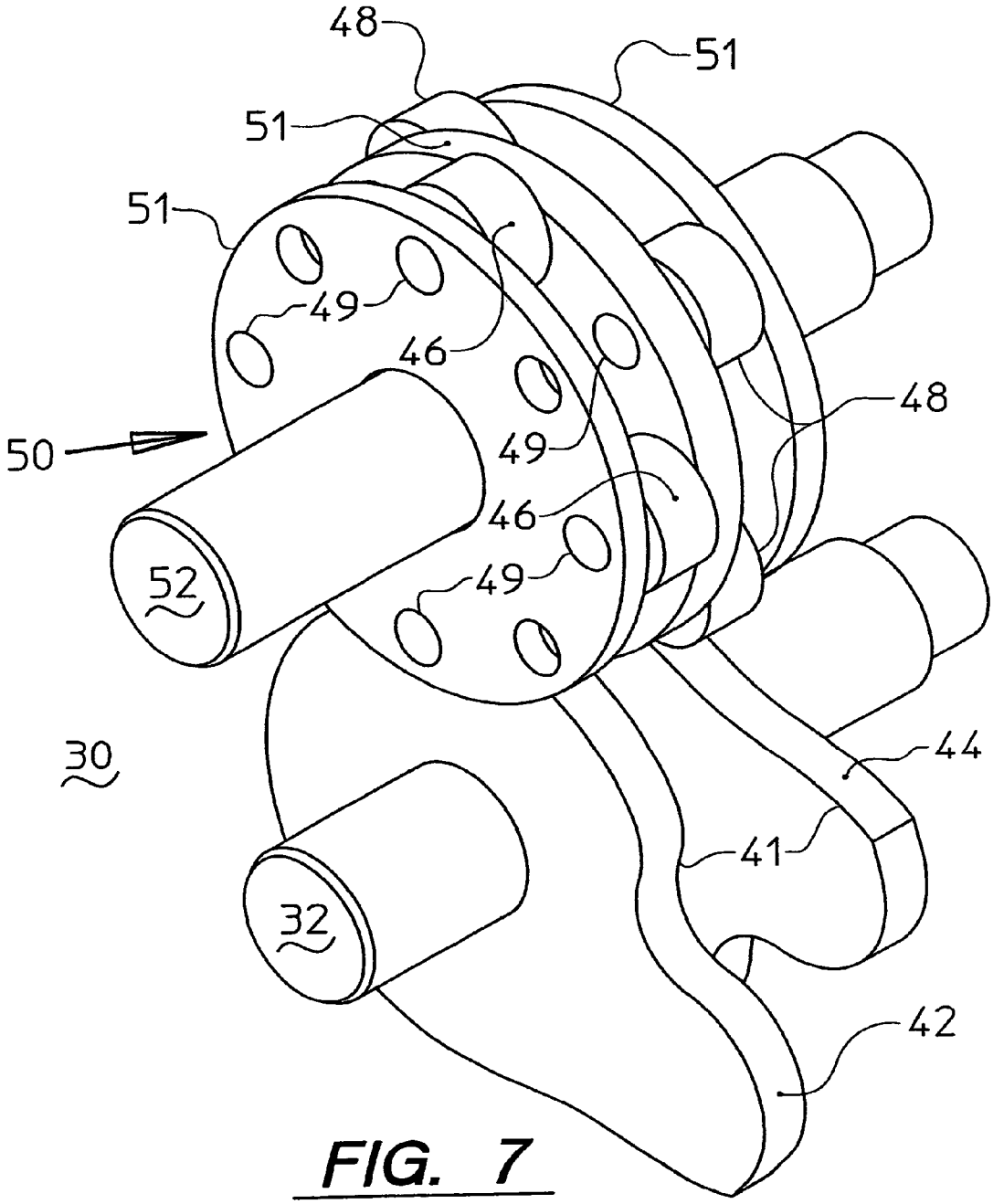
FIG. 7 is a perspective view of an indexing drive for actuating the feeder.

Conveyor belts 26 are supported on a grate 70 as shown in FIGS. 2, 3 and 5. When grate 70 is in a lowered position it will disengage the belts 26 from the boards 10, which will then rest on support strips 27, and when the grate 70 is in a raised position the belts 26 will engage the boards and drive them with indexing movement as will be described below. Referring to FIG. 3, grate 70 is raised and lowered by means of a rocker shaft 76, a horizontally reciprocable rocker link 78 connected to rocker shaft 76 by a rocker arm 80, and vertically reciprocable rocker links 82 connected to lugs 84 depending from grate 70. Referring to FIGS. 4 and 6, rocker shaft 76 is activated by means of a push rod 86 driven by a grate cam 88 engageable with a follower 90 on arm 92 pivotally connected to push rod 86. The latter is connected to rocker shaft 76 by an arm 94. Grate cam 88 is fixed to input shaft 32 to be driven thereby to periodically raise and lower belt support grate 70.

At the beginning of a feed cycle when the trailing edge of the preceding board just clears the gate 12 (see FIG. 10*c*), feeder belts 26 are engaged with the board 10 and the output shaft 60 starts from zero velocity and accelerates the board 10 to a velocity greater than the velocity of the nip rolls 14 (see FIG. 9*a*) after which it decelerates the board to the velocity of the nip rolls 14 just as the board arrives at the nip rolls. At the beginning of the drive phase of the feed cycle, the board does not begin to move until the trailing end of the previous board has cleared gate 12. Due to its acceleration the trailing board catches up with the previous board at the nip rolls 14. At that point the grate 70 is lowered to disengage the belts 26 from the board. After an angle of rotation of the input shaft 32 has occurred preferably 120°, the drive mechanism enters the dwell phase of the cycle where the output shaft 60 is at zero velocity for the remainder of the cycle, as shown in FIG. 9*a*. However as shown in FIGS. 8*a* and 8*b*, the input shaft 32 which was operating at constant velocity during the drive phase, either accelerates and then decelerates (FIG. 8*a*) or decelerates and then accelerates (FIG. 8*b*) during the dwell phase depending on the desired duration of the cycle which in turn depends on the length of the boards being processed. To process shorter length boards with minimum or no spacing therebetween downstream of the nip rolls, the input shaft 32 is accelerated, then decelerated during the dwell phase (see FIG. 8*a*) and to process longer length boards, the input shaft is decelerated, then accelerated during the dwell phase (see FIG. 8*b*). The dwell phase occurs during a preferable 240° rotation of the input shaft 32, it being understood that one cycle occurs during 360° rotation of the input shaft 32. With the computer 35 the operation of the servo motor 34 is programmed so that its velocity is automatically changed from a constant velocity during the drive phase to acceleration and deceleration or vice versa during the dwell phase. Such velocity and acceleration and deceleration are easily chosen and entered into the computer 35 or other controller of the servo motor in accordance with the length of the boards to be processed.

The amount of acceleration or deceleration needed for a given sheet length is calculated based on how much the length of the given sheet exceeds or is less than that of the neutral length which is defined by the amount of movement a sheet will undergo downstream during one cycle (360°) of constant velocity movement of the input shaft. FIG. 8 illustrates the neutral sheet length resulting from a constant velocity of the input shaft over 360° of movement. Sheets greater in length than the neutral length will require a deceleration and acceleration of the input shaft during the dwell phase and sheets less in length, acceleration and deceleration of the input shaft. The specific amount of acceleration and deceleration will of course be calculated based on the difference in length between the neutral sheet length and the desired sheet length. FIG. 8*a* illustrates the input shaft velocity programmed for a particular sheet length less than the neutral sheet length. During the beta phase when the sheet is being accelerated and decelerated (see FIG. 9*a*) to the nip rolls 14 during the first 120° of angular movement of the input shaft 32, the velocity of the input shaft 60 is constant. The value 1.0 on FIG. 8*a* indicates the velocity of the nip rolls. The vertical line at the 120° angle of FIGS. 8*a*, 8*b* and 8*c* indicates the end of the beta phase and the beginning of the dwell phase where the velocity of the output shaft 60 is zero, see FIGS. 9*a* and 9*c*. During the dwell phase as shown in FIG. 8*a* between 120° and 360° of angular movement of the input shaft, the input shaft velocity is accelerated and then decelerated to the same constant velocity shown as the value 1 in FIG. 8*a* whereupon the cycle is repeated. FIG. 8*b* illustrates the input shaft velocity programmed for a sheet length more than the neutral sheet length and which is therefore decelerated and then accelerated.

Figure 10A:
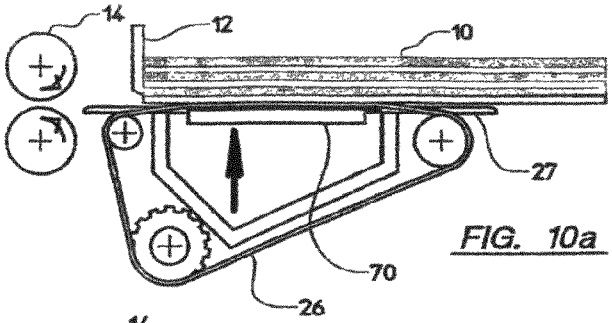
Figure 10B:
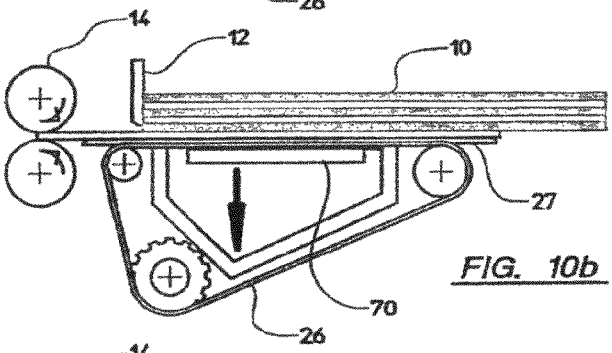
Figure 10C:
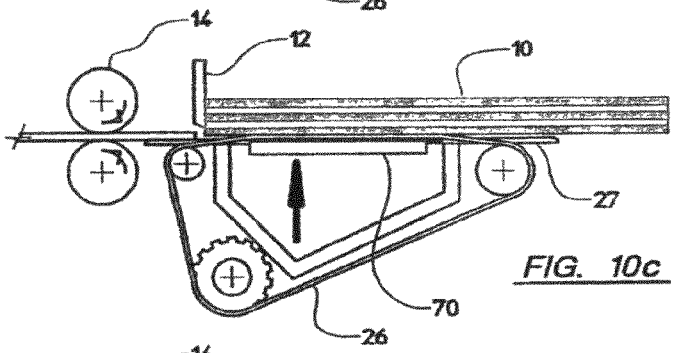

Reviewing a cycle of operation, FIG. 10*a* shows the beginning of a cycle where the belts 26 have just been raised in contact with the underlying board 10 in the supply stack to commence feeding the board. The board is accelerated beyond the nip roll velocity and then decelerated until it arrives at the nip roll velocity which occurs at the nip rolls 14 as shown in FIG. 10*b*. The latter movement occurs while the input shaft was moving at constant velocity (see FIGS. 8*a* or *b*) over an input angle of 88° (see FIG. 9*a*). At that point, feed belts 26 are lowered away from the board as indicated by the arrow in FIG. 10*b* while the board continues to be fed downstream by the nip rolls 14. If the length of the boards being fed is less than the neutral sheet length, the input shaft 32 will have been programmed to accelerate after 120° of rotation from the start of a cycle and then decelerate to its original constant velocity (see FIG. 8*a*) while the output shaft 60 is in the dwell position at zero velocity (see FIG. 9*a*). On the other hand, if the board being fed is greater in length than the neutral sheet length, the input shaft will decelerate and then accelerate to its original constant velocity (see FIG. 8*b*). When the board fed by the nip rolls 14 clears gate 12 as shown in FIG. 10*c*, belts 26 will be raised to engage the next board (as shown by the arrow in FIG. 10*c*) and accelerate it beyond the nip roll velocity Vo. (see FIG. 9*a*) and then decelerate it in order that the next or trailing board may catch up with the preceding board to close the gap therebetween as shown in FIG. 10*e*. The feeder is designed so that the trailing board will catch up with the preceding board at the nip rolls 14 as illustrated in FIG. 10*e* whereupon the belts 26 will be moved downwardly from the trailing board as shown by the arrow in FIG. 10*e*. In FIG. 9*a* this occurs at 88° of angular input movement when the velocity of the output shaft is decelerated to reach the velocity Vo of the nip rolls 14.

Figure 10D:
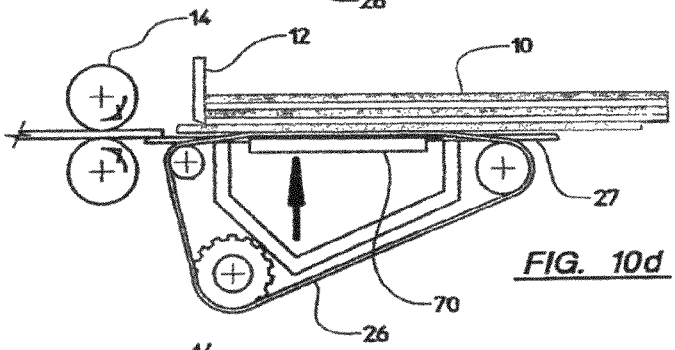
Figure 10E:
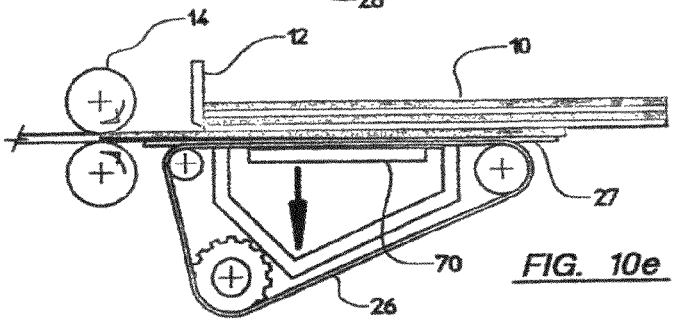

FIG. 10*d* illustrates the gap between the preceding board and the trailing board at a certain point in the cycle, and FIG. 9*b* illustrates the gap when the boards move between the positions shown in FIGS. 10*c* and 10*e* where Ko in the graph represents the preceding board and K the trailing board.

When the boards are in the position shown in FIG. 10*c* the gap is essentially zero and then the gap increases as illustrated in FIG. 10*d* and then the gap closes when the trailing board catches up with the preceding board at the nip rolls as illustrated in FIG. 10*e*.

Referring to FIG. 8*c*, it represents another program of the feeder in accordance with the present invention which allows even shorter or longer sheets to be fed with minimum or no gap therebetween. This is accomplished by initiating acceleration or deceleration of the input shaft 32 earlier in the cycle when the input shaft reaches, for example, approximately 90° of input angular movement just after the board reaches the nip rolls as shown in FIG. 10*b* and the belts 26 are moved downwardly to disengage from the board. The acceleration and deceleration of the input shaft in this embodiment is of course represented by the curve in FIG. 8*c* which differs from that of FIG. 8*a*. Since the input shaft in the version of FIG. 8*c* undergoes acceleration sooner over a greater time period than that of 8*a*, the duration of the dwell phase and therefore the overall cycle can be made to be shorter than that of 8*a* thus allowing shorter sheets to be fed with little or no gap therebetween once they leave the nip rolls 14.

With reference to FIG. 9*c*, when a sheet reaches the nip rolls 14 under the drive of the belts 26 the leading edge of the sheet is engaged by the nip rolls. To minimize if not eliminate any slippage of the sheet at this point, the indexing cams 41 may be made to drive the output shaft 60 with constant velocity equal to the nip roll velocity for only a short interval just before and after it is initially engaged by nip rolls 14. This interval is represented by the horizontal portion CV1 in FIG. 9*c*.

It will thus be seen that the present invention allows sheets of varying lengths to be processed with precise timing or register with little or no gaps therebetween once they reach a downstream location or conveyor such as the nip rolls or other conveyors. Although one preferred feeder has been described and shown above, it will be apparent to those of ordinary skill in the art that the present invention is not limited thereto but may be applied to other feeders such as, for example, those that use rotating wheels rather than endless belts to drive the sheets. Also it is not necessary to vertically move the feeding elements, either belts or wheels, to engage and disengage the sheets. Instead this can be accomplished equally well by moving the support strips 27 vertically by means of the grate movement. The latter method is shown in Sardella U.S. Pat. No. 4,681,311 cited above and whose disclosure is incorporated by reference into the subject application as part hereof. Moreover the feeder of the present invention may be used to print sheets and articles other than corrugated boards, and the sheets may be made from paper, paperboard, plastic, metal, glass and other materials and combinations of materials. Furthermore the present invention may be used in stream feeders or others where timing is not essential but where it is desired to reduce or eliminate the gap between the articles being fed in a consistent manner. Therefore the scope of the present invention is not to be limited to the specific embodiment shown and described above but rather is reflected in the claims appended hereto.

What is claimed is:

1. A method of feeding articles in a timely manner to a conveyor which is moving at a first speed for delivering the articles for processing downstream of the conveyor in accordance with a predetermined time cycle, the steps comprising:

feeding the articles at a speed greater than the first speed and then decelerating the articles to reach said first speed when the articles reach said conveyor, driving the articles with an indexing mechanism having an input shaft rotatable at a velocity and an output shaft connected to a feed member for driving the articles, disengaging the feed member from the articles when they reach said conveyor, said indexing mechanism having a time cycle including a feeding phase driving the articles in acceleration and deceleration and a dwell phase during which the output shaft is at zero velocity and the feed member is not engaged with the articles, wherein during the feeding phase operating the input shaft at constant velocity while the output shaft accelerates and decelerates the feed member and the articles, and wherein during the dwell phase varying the velocity of the input shaft to vary the time cycle.

2. The method defined in claim 1 wherein during the dwell phase increasing then decreasing the speed of the input shaft to shorten a duration of the time cycle.

3. The method defined in claim 1 wherein during the dwell phase decreasing then increasing the speed of the input shaft to lengthen a duration of the time cycle.

4. The method defined in claim 1 including a step of using a servo motor for driving the input shaft at a constant velocity during the feeding phase and at a variable velocity during the dwell phase.

5. The method defined in claim 4 including a step of programming the servo motor to automatically change speeds during said cycle.

6. The method defined in claim 5 including a step of using a computer to program the servo motor.

7. The method defined in claim 1 including the step of feeding the articles in substantially abutting relationship.

8. The method defined in claim 7 applied to digital printing of corrugated boards and including the step of feeding the boards along a linear path directly to a digital printer.

9. The method defined in claim 1 including the step of using a cam and cam follower in the indexing mechanism for driving and controlling the output shaft.

10. In a method of using a timed feeder for delivering articles to a location downstream of the feeder wherein the feeder includes:

a feed member for moving the articles downstream, an indexing drive mechanism for accelerating and decelerating the feed member for moving the articles, said indexing mechanism including an input shaft and an output shaft connected to said feed member, a cycle including a drive phase during which the input shaft is at constant velocity as the output shaft drives the feed member in acceleration and deceleration, and a dwell phase during which the output shaft is at zero velocity and the feed member is disengaged from the article;

the step including accelerating or decelerating the input shaft during the dwell phase to change the time interval of the cycle.

11. The method of claim 10 including the steps of conveying the articles to a conveyor at said location, and during said drive phase the output shaft accelerates said feed member beyond a speed of said conveyor and then decelerates the feed member to match the speed of said conveyor as the input shaft is at constant velocity.

12. The method of claim 11 including the step of decelerating a speed of the feed member to match the speed of said conveyor when the articles arrive at said conveyor.

13. The feeder method defined in claim 12 further including the steps of using a servo motor for driving said input shaft, and using a computer for programming the servo motor.

14. The method defined in claim 12 including the step of disengaging the feed member from the articles when the articles reach said conveyor.

15. The method defined in claim 10 further including the steps of using a servo motor for driving said input shaft, and using a computer for programming the servo motor.

16. The method defined in claim 10 further including the steps of either accelerating then decelerating or decelerating then accelerating the input shaft during the dwell phase.

17. The method defined in claim 10 including the step of feeding the articles in substantially abutting relationship.

18. The method defined in claim 10 applied to articles being fed directly to a digital printer.

19. The method defined in claim 10 including the step of using a cam and cam follower in the indexing mechanism for driving and controlling the output shaft.

* * * * *